US007510211B2

(12) United States Patent
Clark

(10) Patent No.: US 7,510,211 B2
(45) Date of Patent: Mar. 31, 2009

(54) SNAP-LOCKING INITIATOR ASSEMBLIES FOR INFLATOR DEVICES

(75) Inventor: Marcus Clark, Kaysville, UT (US)

(73) Assignee: Autoliv ASP, Inc., Ogden, UT (US)

( * ) Notice: Subject to any disclaimer, the term of this patent is extended or adjusted under 35 U.S.C. 154(b) by 0 days.

(21) Appl. No.: 10/733,060

(22) Filed: Dec. 11, 2003

(65) Prior Publication Data

US 2005/0126416 A1 Jun. 16, 2005

(51) Int. Cl.
*B60R 21/26* (2006.01)

(52) U.S. Cl. ..... 280/741; 102/530

(58) Field of Classification Search ..... 280/741, 280/736, 737; 102/202.12, 202.14, 530, 102/531, 202.5
See application file for complete search history.

(56) References Cited

U.S. PATENT DOCUMENTS 2,796,024 A * 6/1957 Swaim ..... 102/200
4,306,499 A * 12/1981 Holmes ..... 102/202.4
5,200,574 A * 4/1993 Cunningham et al. ..... 102/530
5,454,320 A 10/1995 Hilden et al.
5,492,366 A * 2/1996 Osborne et al. ..... 280/741
5,533,754 A * 7/1996 Riley ..... 280/741
5,558,366 A 9/1996 Fogle, Jr. et al.
5,602,359 A * 2/1997 Hambro et al. ..... 102/202.5
5,847,310 A * 12/1998 Nagahashi et al. ..... 102/202.6
5,955,699 A * 9/1999 Perotto et al. ..... 102/530
6,056,314 A 5/2000 Shirk et al.
6,146,598 A 11/2000 Duvacquier et al.
6,167,808 B1 * 1/2001 Mramor ..... 102/202.9
6,454,306 B1 * 9/2002 Cunningham et al. ..... 280/806
6,644,198 B1 * 11/2003 Avetisian et al. ..... 102/202.14
2005/0121894 A1 * 6/2005 Brisighella et al. ..... 280/741

FOREIGN PATENT DOCUMENTS

DE 3346146 A1 * 7/1985
GB 2 298 475 A 9/1996

* cited by examiner

*Primary Examiner*—Troy Chambers
(74) *Attorney, Agent, or Firm*—Sally J Brown; Pauley Petersen & Erickson

(57) ABSTRACT

An initiator assembly for an inflator device. The initiator assembly includes an initiator. The initiator has an initiator cup at least in part defining a storage chamber containing at least one reactive charge and has at least one electrical connector in reaction initiating communication with the at least one reactive charge. The initiator assembly also includes an initiator retainer element connected to the initiator and a connector socket. The initiator retainer element is adapted to be disposed on a first side of a wall of the inflator device and the connector socket is adapted to be disposed on a second side of the wall opposite the first side. The initiator assembly is adapted to snap-lock to the inflator device.

24 Claims, 7 Drawing Sheets

SNAP-LOCKING INITIATOR ASSEMBLIES FOR INFLATOR DEVICES

BACKGROUND OF THE INVENTION

This invention relates generally to inflator devices such as for use in inflatable safety restraint installations and, more particularly, to an initiator assembly whereby an initiator is joined to an inflator device.

Inflatable safety restraint installations typically use an inflator device to produce inflation gas for inflating an inflatable airbag in the event of a collision. The inflator device often includes a gas generant material stored within an inflator device housing and a preformed initiator in combination with the housing that actuates the gas generant material. Suitable initiators typically include a reactive charge in combination with one or more electrical connectors. A signal sent through the electrical connector(s) actuates the reactive charge, which produces reaction products that actuate the gas generant material.

Initiators can be joined directly to an inflator device or initiators can be first joined to an adapter plate, and the adapter plate is joined to the inflator device. Although initiators can be directly joined to any wall of inflator devices, initiators are typically directly joined to base portions of inflator devices. When the initiator is joined to an adapter plate, the adapter plate can, for example, form an inflator device base or a portion of the inflator device base.

Currently, initiators are typically joined to inflator devices or adapter plates by way of one of two techniques. A first technique includes inserting the initiator into an appropriate machined interface and crimping the interface to secure the initiator. Such crimping requires that a precise interface be machined into the inflator device or adapter plate. Crimping is thus relatively expensive and at least some crimping processes are known to have quality control problems.

A second technique involves integrally molding an initiator directly to an inflator device or adapter plate using a moldable material, such as a thermoplastic. Such integral molding is typically less expensive than the crimping method mentioned above. However, typical integral molding processes have disadvantages as well. For example, time-consuming precautions are generally needed prior to subjecting the initiator, which often contains a pyrotechnic reactive material, to the molding operations. Also, integral molding processes typically employ only a single type of plastic material to form the entire molded portion. Plastic materials generally used in such integrally molding processes are desirably resistant to atmospheric moisture and crack resistant. Crack resistance is particularly desirable in an area around an initiator cup, or cap, which ruptures upon actuation of the reactive material. Thus, plastic materials available as molding material are generally limited to materials having a desirable balance of moisture resistance and crack resistance. Another disadvantage of such integral molding processes is that a hermetic seal between the initiator and the inflator device can be difficult to maintain as the thermoplastic expands and contracts during temperature cycles common during installation procedures. Therefore, such integral molding processes often require carefully designed joint geometries that may not be possible in some types of inflator devices.

Thus, there remains a need for an initiator assembly that minimizes or eliminates the need for expensive and complicated machining. Further, there remains a need for an initiator assembly that is less expensive, safer to produce, has the desired strength and provides a desirable seal with the inflator device and for an initiator assembly.

SUMMARY OF THE INVENTION

A general object of the invention is to provide an improved initiator assembly.

A more specific objective of the invention is to overcome one or more of the problems described above.

The general object of the invention can be attained, at least in part, through an initiator assembly for an inflator device. The initiator assembly includes an initiator. The initiator has an initiator cup at least in part defining a storage chamber containing at least one reactive charge and having at least one electrical connector in reaction initiating communication with the at least one reactive charge. The initiator assembly also includes an initiator retainer element, connected to the initiator, and a connector socket. The initiator retainer element is adapted to be disposed on a first side of a wall of the inflator device and the connector socket is adapted to be disposed on a second side of the wall opposite the first side. The initiator assembly is adapted to join with the inflator device by a snap-lock connection.

The prior art generally fails to disclose an initiator assembly that provides a desirable seal with the inflator device and an initiator assembly that is relatively inexpensive to produce and easy to join to an inflator device.

The invention further comprehends an initiator assembly for an inflator device having a wall with an opening. The initiator assembly includes an initiator having an initiator cup at least in part defining a storage chamber containing at least one reactive charge and having at least one electrical connector in reaction initiating communication with the at least one reactive charge. The initiator assembly includes an initiator retainer element and a connector socket. The initiator retainer element is connected to the initiator. The initiator retainer element includes two retaining arms, each of the two retaining arms including a latch tab. The connector socket includes a connector socket opening. The retaining arms of the initiator retainer element are adapted to extend through the wall opening of the inflator device and the connector socket opening. The latch tab of each retaining arm is adapted to snap-lock to a surface of the connector socket to connect the initiator assembly to the inflator device wall.

The invention still further comprehends an initiator assembly including an initiator. The initiator includes an initiator cup at least in part defining a storage chamber containing at least one reactive charge. The initiator also includes at least one electrical connector in reaction initiating communication with the at least one reactive charge. The initiator assembly also includes an initiator retainer element connected to the initiator, a connector socket including a connector socket opening and an adapter plate having an adapter plate opening. At least two retaining arms extend from at least one of the initiator retainer element and the connector socket. Each of the at least two retaining arms includes a latch tab. The initiator retainer element is disposed on a first side of the adapter plate and the connector socket is disposed on a second side of the adapter plate opposite the first side. The at least two retaining arms extend through the adapter plate opening and the latch tabs of the retaining arms are snap-locked to a surface of one of the initiator retainer element and the connector socket to connect the initiator retainer element, the adapter plate, and the connector socket together.

As used herein, references to "snap-lock" are to be understood to refer a locking connection by which a locking element is designed to snap, or otherwise move, into place with an abrupt movement and fit tightly over another element.

As used herein, references to "reaction initiating communication" are to be understood to refer to a relationship between an initiating component, such as an electrical connector, and a reactable material, such as a reactive charge, wherein the initiating component is able to actuate reaction of the reactable material.

Other objects and advantages will be apparent to those skilled in the art from the following detailed description taken in conjunction with the appended claims and drawings.

BRIEF DESCRIPTION OF THE DRAWINGS

FIG. 4 is an isometric view of the initiator assembly from a side opposite the side shown in FIG. 2.

DETAILED DESCRIPTION OF THE INVENTION

The present invention provides an initiator assembly that can be connected or joined with an inflator device by a snap-lock connection. The initiator assembly is formed of more than one prefabricated component wherein at least one component has a locking element adapted to snap-lock with a corresponding element on another component, or the inflator device, to snap-lockingly connect or join the components together and/or to the inflator device. As the individual components are separably manufactured and relatively easily assembled, the initiator assembly of the invention is relatively less expensive to produce than typical prior art initiator assemblies.

Figure 1:
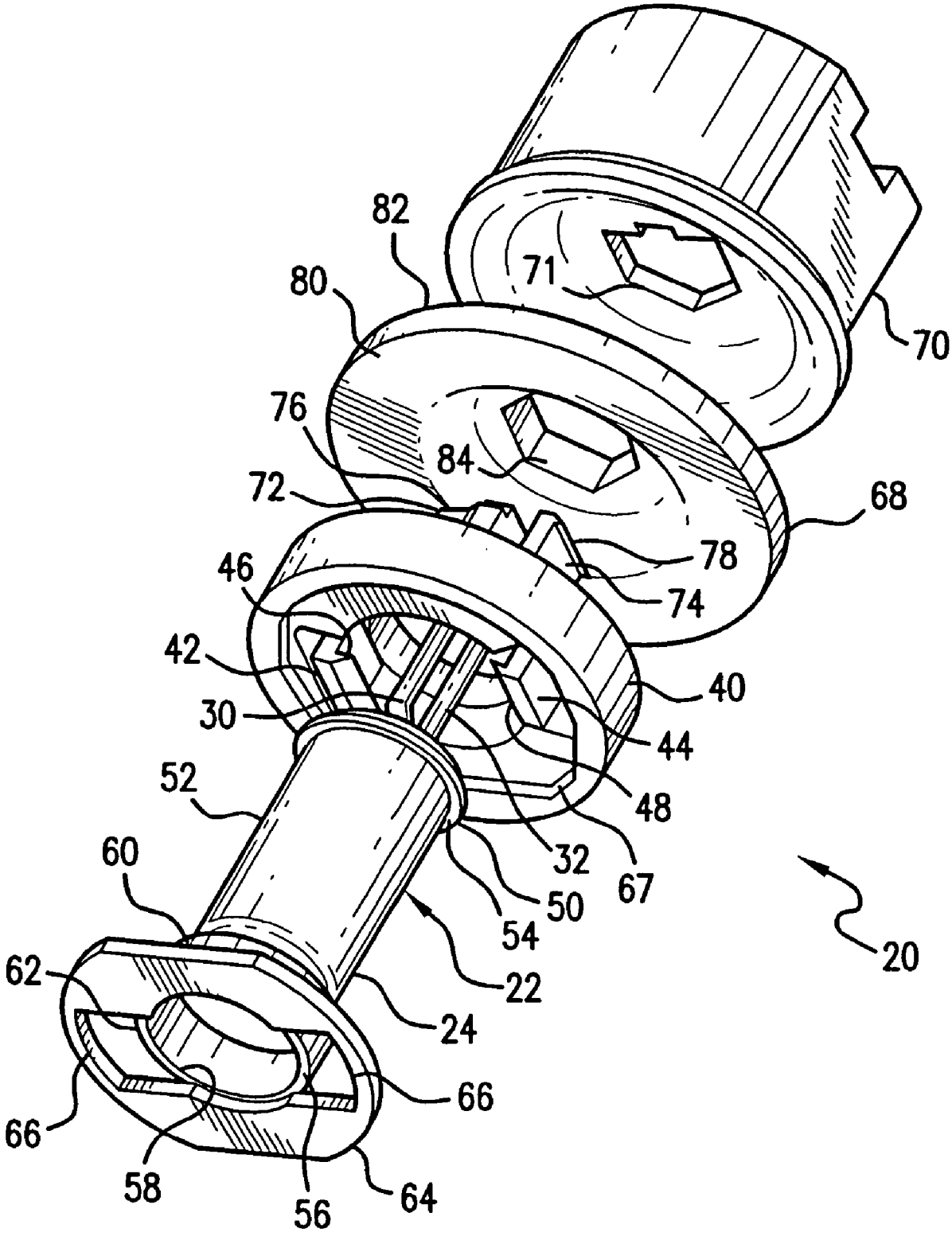
FIG. 1 shows an exploded view of an initiator assembly according to one embodiment of the invention.
Figure 2:
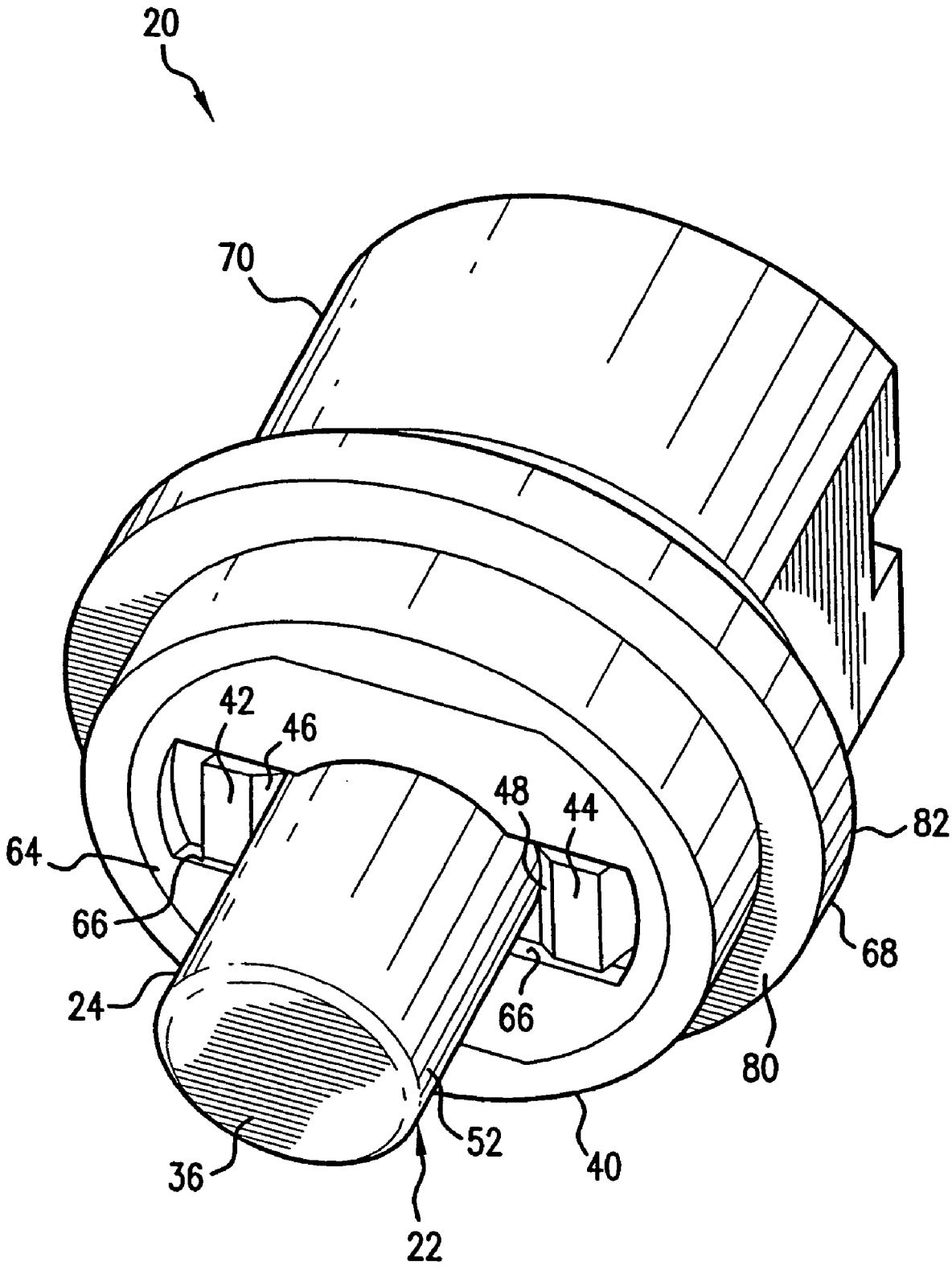
FIG. 2 shows an isometric view of the initiator assembly shown in FIG. 1.
Figure 3:
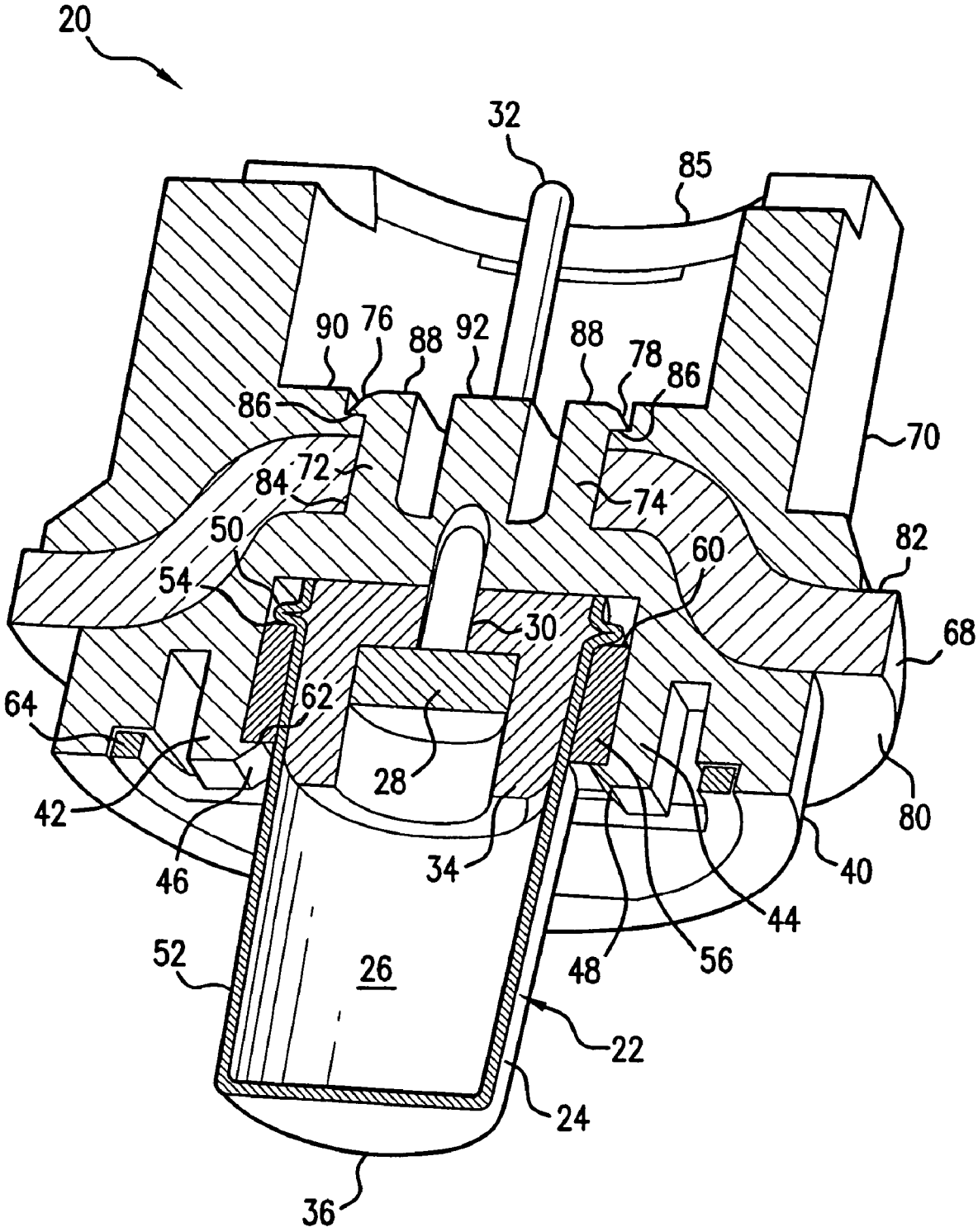
FIG. 3 shows a sectional view of the initiator assembly shown in FIGS. 1 and 2.
Figure 4:
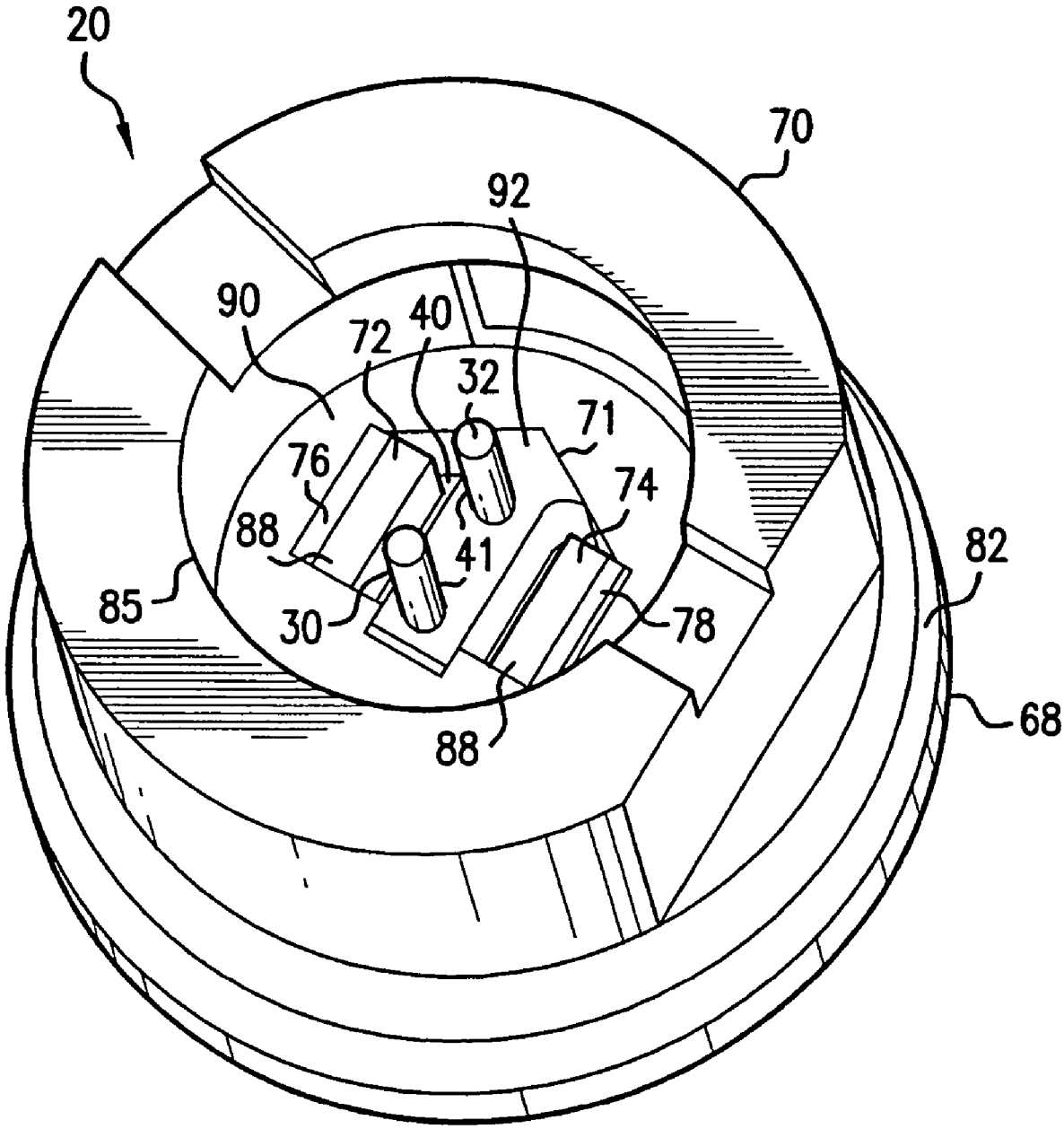
FIG. 4 shows another isometric view of the initiator assembly shown in FIGS. 1-3.

FIGS. 1-4 show an initiator assembly 20 according to one embodiment of the invention. FIG. 1 shows an exploded view of the initiator assembly 20. FIGS. 2-4 show the initiator assembly 20 in an assembled state. As shown in FIGS. 1-3, the initiator assembly 20 includes an initiator 22 having an initiator cup 24. As seen in the sectional view of FIG. 3, the initiator cup 24 in part defines a storage chamber 26 for containing at least one reactive charge 28. The initiator 22 includes two electrical connectors 30 and 32 in reaction initiating communication with the reactive charge 28. Upon receiving a signal through the electrical connectors 30 and 32, the reactive charge 28 is initiated to produce reaction products that desirably rupture the initiator cup 24. A chargeholder 34 is disposed within the storage chamber to direct the reaction products toward an end 36 of the initiator cup 24 opposite the electrical connectors 30 and 32. One or more additional reactive charge(s) (not shown) can also be stored, contained or otherwise disposed within the storage chamber 26 and used in combination with the reactive charge 28. In one embodiment of the invention, the reaction products of the reactive charge 28 can initiate a second reactive charge within the storage chamber 26 to produce additional reactive products.

As shown in FIG. 1, the initiator assembly 20 includes an initiator retainer element 40 connected to the initiator 22. The initiator retainer element 40 is adapted to receive the initiator 22. The initiator retainer element 40 includes two openings, shown in FIG. 4 as openings 41, through which the electrical connectors 30 and 32, respectively, are received. Referring back to the embodiment of the invention shown in FIG. 1, the initiator retainer element 40 also includes two initiator retainer arms 42 and 44 that extend along opposite sides of the initiator 22 and connect the initiator retainer element 40 to the initiator 22. The first initiator retainer arm 42 includes a first latch tab 46 and the second initiator retainer arm 44 includes a second latch tab 48.

The initiator cup 24 includes a raised rim 50 disposed on an outer surface 52. The raised rim 50 is a raised circumferential ring that extends around the circumference of the outer surface 52. The raised rim 50 is formed by a crimp, or fold, in the initiator cup 22. The raised rim has a rim side 54 disposed toward the initiator cup end 36. An initiator sleeve 56 having a centrally disposed opening 58 is adapted to fit around the initiator cup outer surface 52. As shown in FIG. 3, the initiator sleeve 56 is disposed around the initiator cup 22 such that an initiator sleeve first end 60 abuts the rim side 54 of the raised rim 50. The latch tabs 46 and 48 of the two initiator retainer arms 42 and 44 are snap-locked to an initiator sleeve second end 62 opposite the initiator sleeve first end 60. When the initiator 22 and the initiator sleeve 56 are being connected to the initiator retainer element 40, the raised rim 50 and the initiator sleeve 56 bend the initiator retainer arms 42 and 44 outward. When the initiator 22 and the initiator sleeve 56 are fully inserted into the initiator retainer element 40, the initiator retainer arm latch tabs 46 and 48 snap or fasten over the initiator sleeve second end 62, thereby snap-locking the initiator retainer element 40 to the initiator sleeve 56 and the initiator 22. The latch tabs 44 and 46 secure the initiator sleeve first end 60 against the raised rim 50, which is against the initiator retainer element 40, thereby joining or connecting the initiator 22 to the initiator retainer element 40.

In one embodiment of the invention, the initiator sleeve 56 includes a collar flange 64 extending outward from the initiator sleeve 56. The collar flange 64 includes two collar flange apertures 66. Each of the two initiator retainer arms 42 and 44 extends into a corresponding one of the collar flange apertures 66 to allow the latch tabs 46 and 48 to snap-lock to the initiator sleeve 56. The initiator retainer element 40 includes a recess 67 adapted to receive at least a portion of the collar flange 64. Those skilled in the art and guided by the teachings herein provided will appreciate that the inclusion of such a collar flange may desirably facilitate or otherwise provide or result in improved handling during the assembly process, particularly in automated assembly processes. Those skilled in the art and guided by the teachings herein provided will, however, also appreciate that the broader practice of the invention is not necessarily so limited. For example, if desired, the initiator assembly of the invention can be practiced with an initiator sleeve that does not include such a collar flange.

While the invention has been described above making specific reference to an embodiment which includes an initiator sleeve 56 disposed between the latch tabs 46 and 48 and the raised rim 50, one skilled in the art following the teachings herein provided will appreciate that the broader practice of the invention is not necessarily so limited. For example, in accordance with an alternative embodiment of the invention, the latch tabs of associated initiator retainer arms snap-lock directly to a surface of an initiator raised rim. In addition, as will be appreciated by one skilled in the art following the teachings herein provided, the raised rim, depending on the configuration of specific embodiments of the initiator assembly, can include various sizes, shapes and placements on the initiator cup. As will also be appreciated, the initiator retainer arms can include various sizes, shapes and placements, depending on the desired configuration of specific embodiments of the initiator assembly and the inflator device with which the initiator assembly is joined or connected.

The initiator assembly of the invention can desirably be assembled from prefabricated or premolded components, such as, for example, the initiator retainer element 40, that can be snap-locked, or otherwise press-fitted, together to connect an initiator to an inflator device. The prefabricated components avoid the disadvantages of an integral molded initiator assembly described above. The initiator assembly of the invention can be relatively easily connected to any wall of an inflator device, such as an inflator device base. The initiator assembly of the invention can also include an adapter plate that can be connected, such as by crimping or welding, to an inflator device. The adapter plate forms at least a portion of an inflator device wall. In one embodiment of the invention, the adapter plate forms one wall of an inflator device, desirably a base of the inflator device. FIGS. 1-4 show the initiator assembly 20 in combination with a plate 68, and will be described herein with reference to the plate 68. As will be appreciated by one skilled in the art following the teachings herein provided, the plate 68 can be any wall of an inflator device, such as an inflator device base, or an adapter plate for connecting the initiator assembly to an inflator device.

The initiator assembly 20 includes a connector socket 70. The initiator retainer element 40 and the connector socket 70 are disposed on opposite sides of the plate 68 and connect through a centrally disposed opening in the plate 68, thereby connecting the initiator assembly 20 to the plate 68. In one embodiment of the invention, either the initiator retainer element, the connector socket or both the initiator retainer element and the connector socket include at least two retaining arms. Each of the retaining arms includes a latch tab which allows the retaining arm to snap-lock to a surface of the other of the initiator retainer assembly or the connector socket.

As shown in FIGS. 1, 3 and 4, the initiator assembly 20 includes two retaining arms 72 and 74 extending from the initiator retainer element 40 on a side opposite the initiator 22. The first retaining arm 72 includes a latch tab 76 and the second retaining arm includes a latch tab 78. The initiator retainer element 40 is disposed on a first side 80 of the plate 68 and the connector socket 70 is disposed on a second side 82 of the plate 68 opposite the first side 80. The plate 68 includes a centrally disposed opening 84. The retaining arms 72 and 74 extend through the plate opening 84 and snap-lock the initiator retainer element 40 and the connector socket 70 together.

The connector socket 70 includes a connector socket opening 71. When the initiator assembly 20 is assembled and connected to plate 68, as shown in FIGS. 3 and 4, the retaining arms 72 and 74 and the electrical connectors 30 and 32 extend into and/or through the connector socket opening 71. The connector socket 70 includes an interface 85 adapted to receive an electrical receptacle for attaching to the electrical connectors 30 and 32. Within the interface 85, two shoulders 86 are adjacent to the connector socket opening 71. When inserted into the connector socket opening 71, the retaining arms 72 and 74 are adapted to bend inward due to contact with the sides of the connector socket opening 71. When the retaining arms 72 and 74 are fully inserted into the connector socket opening 71, the retaining arm latch tabs 76 and 78 become aligned with the shoulders 86 and snap or fasten over the shoulders 86, respectively. The latch tabs 76 and 78 engage the shoulders 86 to snap-lock the initiator retainer element 40 and the connector socket 70 together through the plate opening 84, thereby connecting the initiator retainer element 40 and the connector socket 70 to the plate 68. The shoulders 86 allow the tops 88 of the retaining arms 72 and 74 to be aligned, or flush, with the inner surface 90 of the connector socket 70.

As shown in FIG. 4, the interface 85 contains a portion of the electrical connectors 30 and 32. The connector socket opening 71 is shaped to receive a correspondingly shaped portion 92 of the initiator retainer element 40. The electrical connectors extend through two holes 41 in the initiator retainer element shaped portion 92. The shaped connector socket opening 71 and the initiator retainer element shaped portion 92 can ensure the initiator retainer element 40 and the connector socket 70 are properly connected as desired. The connector socket opening 71 has a generally trapezoidal shape. As will be appreciated by one skilled in the art, various sizes and shapes of the connector socket opening and the corresponding initiator retainer element portion are available for specific embodiments of the initiator assembly of the invention.

In one embodiment of the invention, the initiator retainer element 40, initiator sleeve and the connector socket 70 are formed of a plastic material. After being joined together, the initiator retainer element 40 and the connector socket 70 can be welded together and to the plate 68, such as by ultrasonic welding. In one embodiment of the invention, each of the prefabricated plastic components of the initiator assemblies can be formed from different types of plastic. Using more than one plastic material in producing the initiator assembly of the invention provides desired characteristics to individual components, depending on the placement and/or function of the component. For example, the initiator retainer element 40 at least partially surrounds the initiator cup 24. The initiator retainer element 40 is desirably made from a relatively strong, crack-resistance plastic to reduce or eliminate cracking upon actuation of the reactive charge 28. In addition, upon assembly of the inflator device the connector socket 70 may be located in contact with the surrounding atmosphere. Forming the connector socket 70 from a different, relatively moisture-resistant plastic material, can reduce or eliminate moisture penetration into the inflator device through the initiator assembly.

Figure 5:
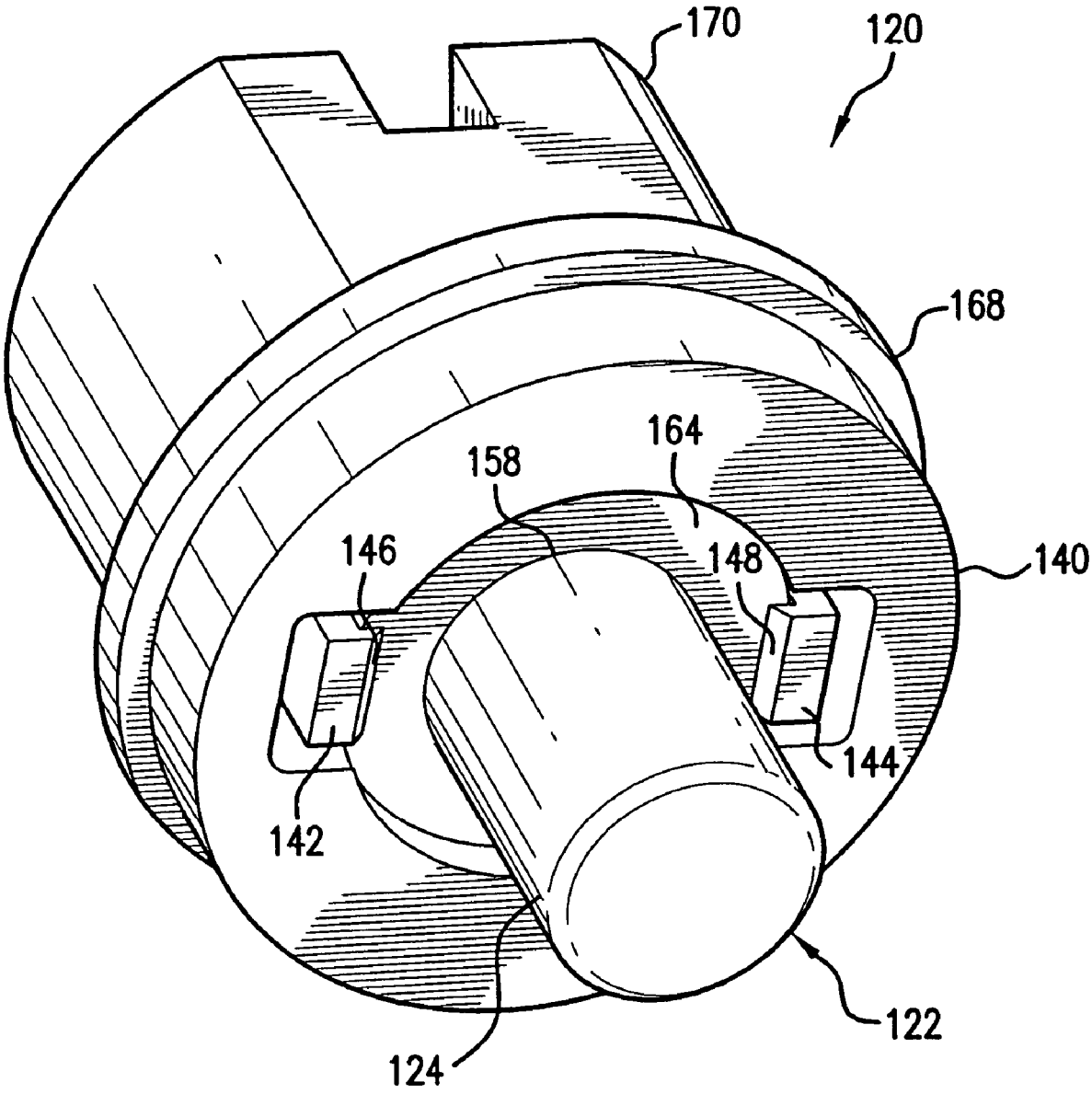
FIG. 5 shows an isometric view of an initiator assembly according to another embodiment of the invention
Figure 6:
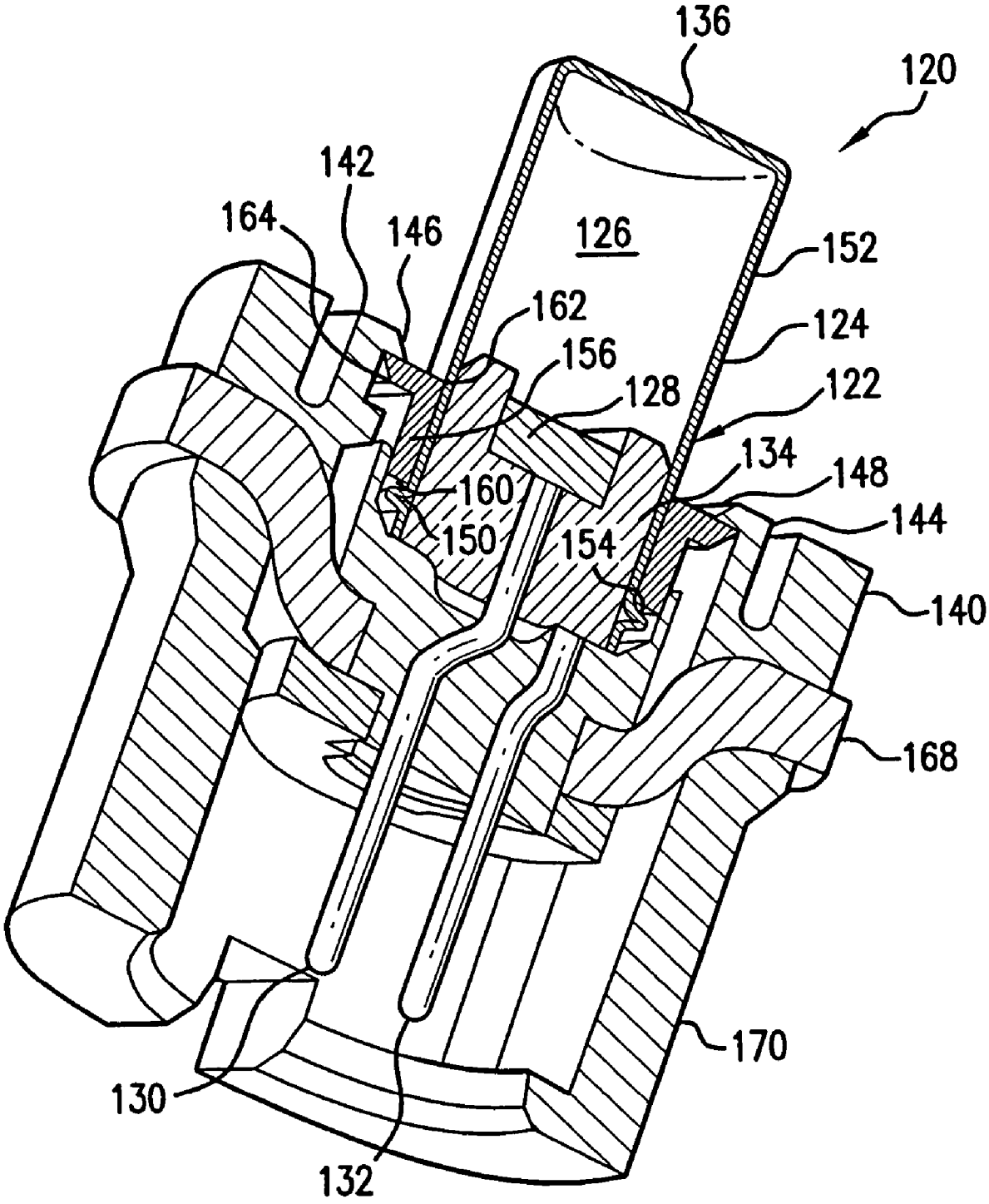
FIG. 6 shows a sectional view of the initiator assembly shown in FIG. 5.

FIGS. 5 and 6 show an initiator assembly 120 according to another embodiment of the invention. FIG. 5 shows the initiator assembly 120 in an assembled state. FIG. 6 shows a sectional view of the initiator assembly 120. As shown in FIGS. 5 and 6, the initiator assembly 120 includes an initiator 122 having an initiator cup 124. As seen in the sectional view of FIG. 6, the initiator cup 124 in part defines a storage chamber 126 for containing at least one reactive charge 128. The initiator 122 includes two electrical connectors 130 and 132 in reaction initiating communication with the reactive charge 128. Upon receiving a signal through the electrical connectors 130 and 132, the reactive charge 128 is initiated to produce reaction products that desirably rupture the initiator cup 124. A chargeholder 134 is disposed within the storage chamber to direct the reaction products toward an end 136 of the initiator cup 124 opposite the electrical connectors 130 and 132.

The initiator assembly 120 includes an initiator retainer element 140 connected to the initiator 122. The initiator retainer element 140 is adapted to receive the initiator 122. The initiator retainer element 140 also includes two initiator retainer arms 142 and 144 that extend along opposite sides of the initiator 122 and connect the initiator retainer element 140 to the initiator 122. The first initiator retainer arm 142 includes a first latch tab 146 and the second initiator retainer arm 144 includes a second latch tab 148.

The initiator cup 124 includes a raised rim 150 disposed on an outer surface 152. The raised rim 150 is a raised circumferential ring that extends around the circumference of the outer surface 152. The raised rim 150 is formed by a crimp, or fold, in the initiator cup 122. The raised rim has a rim side 154 disposed toward the initiator cup end 136. An initiator sleeve 156 having a centrally disposed opening 158 is adapted to fit around the initiator cup outer surface 152. The initiator sleeve includes a collar flange 164 extending outward from the initiator sleeve 156 at a second end 162.

As shown in FIG. 6, the initiator sleeve 156 is disposed around the initiator cup 122 such that an initiator sleeve first end 160 abuts the rim side 154 of the raised rim 150. The latch tabs 146 and 148 of the two initiator retainer arms 142 and 144 are snap-locked to the initiator sleeve second end 162 by snap-locking to the collar flange 164. The attachment of the retaining arms 142 and 144 to the collar flange 164 of the initiator sleeve 156 is one difference between the initiator assembly 120 and the initiator assembly 20, shown in FIGS. 1-3, which is described above as including initiator retainer arms 42 and 44 that extend through the collar flange apertures 66 to snap-lock directly to the initiator sleeve second end 62.

When the initiator 122 and the initiator sleeve 156 are being connected to the initiator retainer sleeve 140, the collar flange 164 bends the initiator retainer arms 142 and 144 outward. When the initiator 122 and the initiator sleeve 156 are fully inserted into the initiator retainer element 140, the initiator retainer arm latch tabs 146 and 148 snap or fasten over the collar flange 164, thereby snap-locking the initiator retainer element 140 to the initiator 122 and the initiator sleeve 156. The latch tabs 144 and 146 secure the initiator sleeve first end 160 against the raised rim 150, thereby joining or connecting the initiator 122 to the initiator retainer element 140.

The initiator assembly 120 includes a connector socket 170. The initiator retainer element 140 and the connector socket 170 are disposed on opposite sides of a plate 168, such as or similar to, for example, the plate 68 described above, and connect through a centrally disposed opening in the plate 168, thereby connecting the initiator assembly 120 to the plate 168. In one embodiment of the invention, either the initiator retainer element, the connector socket or both the initiator retainer element and the connector socket include at least two retaining arms, such as described above with reference to FIGS. 1-4. Each of the retaining arms includes a latch tab which allows the retaining arm to snap-lock to a surface of the other of the initiator retainer element or the connector socket.

Figure 7:
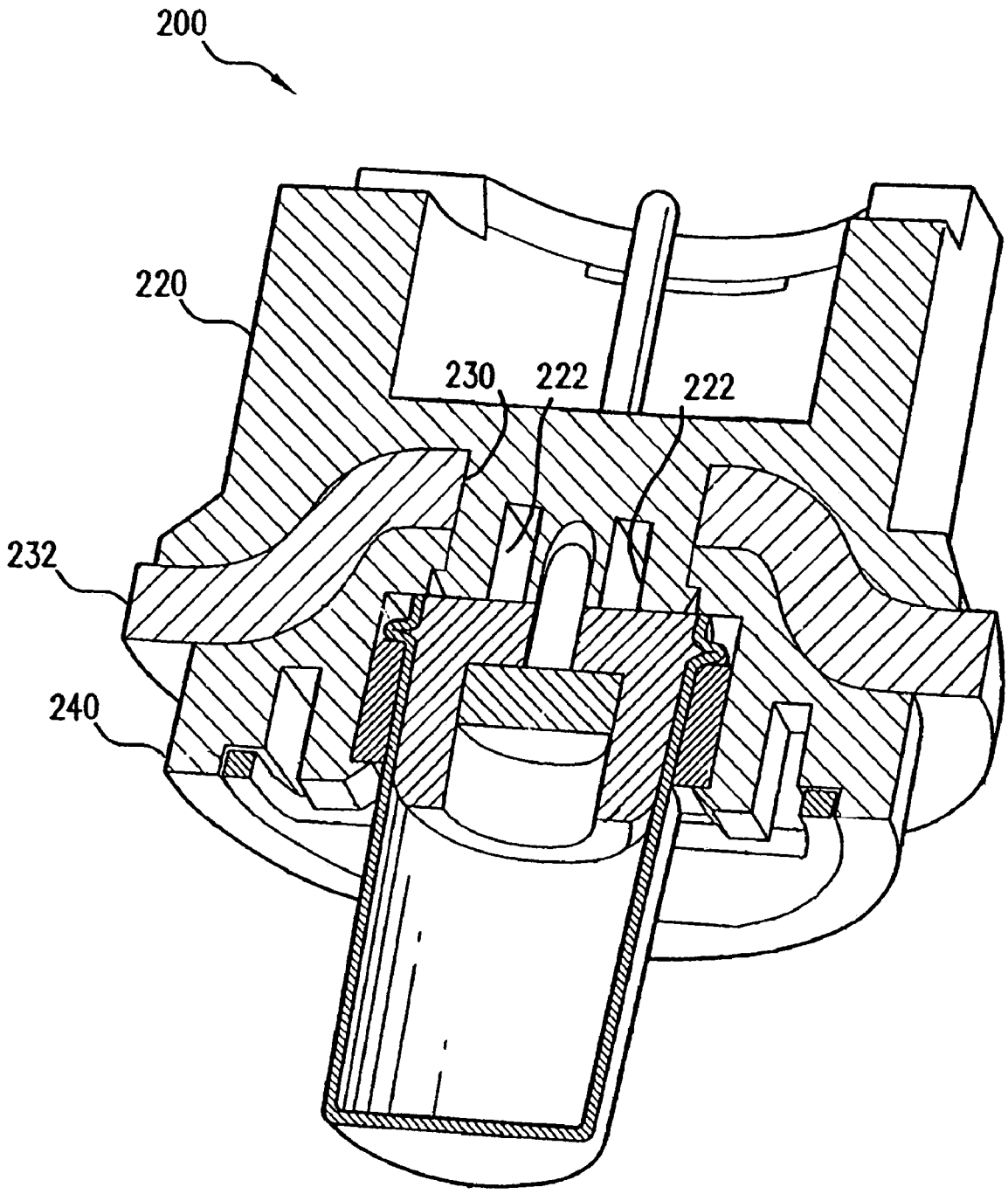
FIG. 7 shows a sectional view of the initiator assembly according to yet another embodiment of the invention.

FIG. 7 shows a sectional view of the initiator assembly 200 according to yet another embodiment of the invention. The initiator assembly 200 includes a connector socket 220 including two retaining arms 222 extending through an opening 230 in plate 232. The two retaining arms 222 snap-lock the connector socket to an initiator retainer element 240.

While the invention has been described above with reference to an initiator retainer element and a connector socket adapted to snap-lock together, the broader practice of the invention is not necessarily so limited. As will be appreciated by those skilled in the art following the teachings herein provided, the initiator assembly of the invention can include an initiator retainer element and/or a connector socket that individually, i.e., separately, snap-lock(s) to an inflator device wall, inflator base or an adapter plate to connect or join the initiator assembly to the inflator device or adapter plate. In one embodiment of the invention, each of the initiator retainer element and the connector socket include at least one retaining arm having a latch tab that snap-locks, thereby snap-locking the initiator retainer element and the connector socket, directly to the inflator device wall, inflator device base or adapter plate.

Thus, the invention provides an initiator assembly that can be snap-lockingly joined or connected to an inflator device. The snap-locking components of the initiator assembly provide an initiator assembly that is relatively inexpensive and easy to produce and assemble with an inflator device.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. An initiator assembly for an inflator device, comprising:

an initiator including an initiator cup at least in part defining a storage chamber containing at least one reactive charge and the initiator also including at least one electrical connector in reaction initiating communication with the at least one reactive charge;

a raised rim on an outer surface of the initiator cup, the raised rim including a rim side disposed toward an end of the initiator opposite the at least one electrical connector;

an initiator sleeve including a centrally disposed opening disposed around the outer surface of the initiator cup and the initiator sleeve including an initiator sleeve first end abutting the rim side of the raised rim; and an initiator retainer element connected to the initiator, the initiator retainer element including at least two initiator retainer arms having latch tabs, wherein the latch tabs of the at least two initiator retainer arms are snap-locked to an initiator sleeve second end of the initiator sleeve opposite the initiator sleeve first end to connect the initiator retainer element to the initiator; and a connector socket;

wherein the initiator retainer element is adapted to be disposed on a first side of a wall of the inflator device and the connector socket is adapted to be disposed on a second side of the wall opposite the first side, and the initiator assembly is adapted to join with the inflator device by a snap-lock connection.

2. The initiator assembly of claim 1, additionally comprising at least two retaining arms extending from at least one of the initiator retainer element and the connector socket, each of the at least two retaining arms including a latch tab;

wherein the at least two retaining arms are adapted to extend through the opening in the inflator device to snap-lock the initiator retainer element and the connector socket together.

3. The initiator assembly of claim 2 wherein the at least two retaining arms extend from the initiator retainer element.

4. The initiator assembly of claim 3 wherein the connector socket includes a connector socket opening and at least one shoulder adjacent the connector socket opening and the latch tabs of the at least two retaining arms are adapted to engage the at least one shoulder to snap-lock the initiator retainer element and the connector socket together.

5. The initiator assembly of claim 1 wherein the initiator sleeve comprises a collar flange.

6. The initiator assembly of claim 5 additionally comprising:

at least two collar flange apertures in the collar flange; and a recess formed in the initiator retainer element;

wherein each of the at least two initiator retainer arms extends into one of the at least two collar flange apertures and at least a portion of the initiator sleeve collar flange is disposed in the initiator retainer element recess.

7. The initiator assembly of claim 1 wherein the raised rim is a raised circumferential ring.

8. The initiator assembly of claim 1 wherein the initiator retainer element and the connector socket are formed of a plastic material.

9. The initiator assembly of claim 1, wherein the initiator retainer element and the connector socket are adapted to snap-lock together through an opening in the inflator device.

10. An initiator assembly for an inflator device, comprising:

an initiator including an initiator cup at least in part defining a storage chamber containing at least one reactive charge and the initiator also including at least one electrical connector in reaction initiating communication with the at least one reactive charge;

an initiator retainer element connected to the initiator;

a connector socket; and at least two retaining arms extending from the connector socket, each of the at least two retaining arms including a latch tab;

wherein the initiator retainer element is adapted to be disposed on a first side of a wall of the inflator device and the connector socket is adapted to be disposed on a second side of the wall opposite the first side, and the at least two retaining arms are adapted to extend through an opening in the inflator device to snap-lock the initiator retainer element and the connector socket together to join with the inflator device by a snap-lock connection.

11. An initiator assembly for an inflator device, the initiator assembly comprising:

an initiator including an initiator cup at least in part defining a storage chamber containing at least one reactive charge and the initiator also including at least one electrical connector in reaction initiating communication with the at least one reactive charge;

an initiator retainer element connected to the initiator, the initiator retainer element including two retaining arms and each of the two retaining arms including a latch tab; and a connector socket including a connector socket opening and at least one shoulder adjacent the connector socket opening;

wherein the retaining arms of the initiator retainer element are adapted to extend through a wall opening of the inflator device and the connector socket opening, and the latch tab of each retaining arm is adapted to snap-lock to a surface of the connector socket to connect the initiator assembly to the inflator device wall, wherein the latch tabs of the at least two retaining arms are adapted to engage the at least one shoulder to snap-lock the initiator retainer element and the connector socket togethet.

12. The initiator assembly of claim 11 additionally comprising:

a raised rim on an outer surface of the initiator cup, the raised rim including a rim side disposed toward an end of the initiator opposite the at least one electrical connector; and at least two initiator retainer arms having latch tabs disposed on the initiator retainer element;

wherein the latch tabs of the at least two initiator retainer arms are snap-locked to the rim side to connect the initiator retainer element to the initiator.

13. The initiator assembly of claim 12 wherein the raised rim is a raised circumferential ring.

14. The initiator assembly of claim 11 wherein the initiator retainer element and the connector socket are formed of a plastic material.

15. An initiator assembly comprising:

an initiator including an initiator cup at least in part defining a storage chamber containing at least one reactive charge and the initiator also including at least one electrical connector in reaction initiating communication with the at least one reactive charge;

an initiator retainer element connected to the initiator;

a connector socket including a connector socket opening;

at least one of the initiator retainer element or the connector socket including at least two retaining arms extending therefrom, each of the at least two retaining arms including a latch tab;

an adapter plate including an adapter plate opening;

the initiator retainer element disposed on a first side of the adapter plate and the connector socket disposed on a second side of the adapter plate opposite the first side;

wherein the initiator retainer element and the connector socket are formed of a plastic material and the at least two retaining arms extend from the at least one of the initiator retainer element or the connector socket through the adapter plate opening and the latch tabs of the retaining arms are snap-locked to a surface of an other of the initiator retainer element or the connector socket to connect the initiator retainer element, the adapter plate, and the connector socket together.

16. The initiator assembly of claim 15 additionally comprising:

a raised rim on an outer surface of the initiator cup, the raised rim including a rim side disposed toward an end of the initiator opposite the at least one electrical connector; and at least two initiator retainer arms having latch tabs disposed on the initiator retainer element;

wherein the latch tabs of the at least two initiator retainer arms are snap-locked to the rim side to connect the initiator retainer element to the initiator.

17. The initiator assembly of claim 16 additionally comprising an initiator sleeve including a centrally disposed opening disposed around the outer surface of the initiator cup and the initiator sleeve including an initiator sleeve first end abutting the rim side of the raised rim;

wherein the latch tabs of the at least two initiator retainer arms are snap-locked to an initiator sleeve second end of the initiator sleeve opposite the initiator sleeve first end to connect the initiator retainer element to the initiator.

18. The initiator assembly of claim 17 wherein the initiator sleeve comprises a collar flange.

19. The initiator assembly of claim 18 additionally comprising:

at least two collar flange apertures formed in the collar flange; and a recess formed in the initiator retainer element;

wherein each of the at least two initiator retainer arms extends into one of the at least two collar flange apertures and at least a portion of the initiator sleeve collar flange is disposed in the initiator retainer element recess.

20. The initiator assembly of claim 16 wherein the raised rim is a raised circumferential ring.

21. The initiator assembly of claim 15 wherein the connector socket includes a connector socket opening and at least one shoulder adjacent the connector socket opening and the latch tabs of the at least two retaining arms are adapted to engage the at least one shoulder to snap-lock the initiator retainer element and the connector socket together.

22. An initiator assembly for an inflator device having a wall with an opening, the initiator assembly comprising:

an initiator including an initiator cup at least in part defining a storage chamber containing at least one reactive charge and the initiator also including at least one electrical connector in reaction initiating communication with the at least one reactive charge;

a raised rim on an outer surface of the initiator cup, the raised rim including a rim side disposed toward an end of the initiator opposite the at least one electrical connector an initiator retainer element connected to the initiator, the initiator retainer element including two retaining arms and two initiator retainer arms and each of the two retaining arms and the two initiator retainer arms including a latch tab;

a connector socket including a connector socket opening; and an initiator sleeve including a centrally disposed opening disposed around the outer surface of the initiator cup and the initiator sleeve including an initiator sleeve first end abutting the rim side of the raised rim;

wherein the latch tabs of the at least two initiator retainer arms are snap-locked to an initiator sleeve second end of the initiator sleeve opposite the initiator sleeve first end to connect the initiator retainer element to the initiator and the retaining arms of the initiator retainer element extend through the wall opening of the inflator device and the connector socket opening, and the latch tab of each retaining arm snap-lock to a surface of the connector socket to connect the initiator assembly to the inflator device wall.

23. The initiator assembly of claim 22 wherein the initiator sleeve comprises a collar flange.

24. The initiator assembly of claim 23 additionally comprising:

at least two collar flange apertures formed in the collar flange; and a recess formed in the initiator retainer element;

wherein each of the at least two initiator retainer arms extends into one of the at least two collar flange apertures and at least a portion of the initiator sleeve collar flange is disposed in the initiator retainer element recess.

* * * * *